US007486910B2

(12) United States Patent
Kitozaki

(10) Patent No.: US 7,486,910 B2
(45) Date of Patent: Feb. 3, 2009

(54) CARTRIDGE DETACHABLY MOUNTED TO AN IMAGE FORMING APPARATUS INCLUDING A LOCK MEMBER ENGAGABLE WITH A WALL OF THE IMAGE FORMING APPARATUS

(75) Inventor: Yukihiro Kitozaki, Chiba-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 402 days.

(21) Appl. No.: 11/269,744

(22) Filed: Nov. 9, 2005

(65) Prior Publication Data

US 2006/0104663 A1 May 18, 2006

(30) Foreign Application Priority Data

Nov. 12, 2004 (JP) ..... 2004-329241

(51) Int. Cl.
*G03G 21/16* (2006.01)

(52) U.S. Cl. ..... 399/111; 399/110; 399/119; 399/260; 399/264; 399/358

(58) Field of Classification Search ..... 399/110, 399/111, 119, 260, 264, 358
See application file for complete search history.

(56) References Cited

U.S. PATENT DOCUMENTS

| | | | | |
|---|---|---|---|---|
| 4,614,424 | A | 9/1986 | Endo et al. | 355/56 |
| 6,526,243 | B2 | 2/2003 | Kim et al. | 399/119 |
| 7,010,250 | B1 * | 3/2006 | Yahagi | 399/258 |
| 2002/0085857 | A1 | 7/2002 | Kim et al. | 399/119 |
| 2005/0260018 | A1 * | 11/2005 | Jang et al. | 399/358 |

FOREIGN PATENT DOCUMENTS

| | | | |
|---|---|---|---|
| EP | 0 251 823 | A2 | 1/1988 |
| EP | 1 431 837 | A1 | 6/2004 |
| JP | 60-151622 | | 8/1985 |
| JP | 2-222984 | A | 9/1990 |
| JP | 4-81172 | | 12/1992 |
| JP | 11-95638 | A | 4/1999 |
| JP | 2000-19914 | A | 1/2000 |
| JP | 2002-049287 | | 2/2002 |
| JP | 2003-162192 | A | 6/2003 |
| KR | 2002-0058323 | | 7/2002 |

OTHER PUBLICATIONS

Korean Office Action dated Oct. 19, 2006.
Office Action, dated Dec. 5, 2007, issued in Korean counterpart Application No. 10-2007-0070431.
Office Action, dated Nov. 23, 2007, issued in Chinese counterpart Application No. 2005-10119415.1, including an English-language translation of the Office Action.

* cited by examiner

*Primary Examiner*—David M Gray
*Assistant Examiner*—Ryan D Walsh
(74) *Attorney, Agent, or Firm*—Fitzpatrick, Cella, Harper, & Scinto

(57) ABSTRACT

A process cartridge detachably mounted to an image forming apparatus is provided with a lock mechanism in a shutter member of opening and closing a toner discharge port, and once the process cartridge is mounted onto an image forming apparatus, the lock mechanism is configured to be unlocked so as to enable the shutter member to open and close subject to unlocking of a lock.

11 Claims, 15 Drawing Sheets

CARTRIDGE DETACHABLY MOUNTED TO AN IMAGE FORMING APPARATUS INCLUDING A LOCK MEMBER ENGAGABLE WITH A WALL OF THE IMAGE FORMING APPARATUS

BACKGROUND OF THE INVENTION

1. Field of the Invention

The present invention relates to a cartridge detachably mounted to image forming apparatuses, such as photocopiers and printers of forming images onto recording material by utilizing an electrophotographic system.

2. Related Background Art

In order to improve replaceability of parts, there is such an image forming apparatuses adopting an electrophotographic system that is provided with a cartridge detachably mounted to the image forming apparatus derived by unitizing a plurality of members. For example, there is such a cartridge that removes toner still remaining on a photosensitive member or a transfer belt due to failure in complete consumption for transfer from a photosensitive member or recording material onto a transfer belt to discharge it as waste toner.

In this case, the main body apparatus comprises a housing container of housing waste toner discharged from this cartridge and waste toner carrying means in order to retrieve (or recover) it to the housing container.

There exists a circulation unit of bringing mutual orifices into communication in order to deliver waste toner between this cartridge and the waste toner carrying means (or the housing container), and shutter means is provided so that the orifice of this delivery unit is opened and closed and the toner is not scattered to the outside. Thus, shutter means is essential for the cartridge system detachably mounted to the main body apparatus in order to prevent toner leakage from the cartridge at the time of cartridge replacement (see, for example, Japanese Utility Model Application Laid-Open No. H04-81172).

However, a waste toner shutter in a prior art cartridge in the attach/detach system has presented problems as described below. That is, when a cartridge is detached from/attached to the main body apparatus, a user might touch by mistake the waste toner shutter provided to the cartridge, and then the toner shutter would open to leak toner from the waste toner from a discharge port. In addition, such a problem was present that toner would be stuck (or attracted) onto the surface of the cartridge by the toner leaking from the waste toner receiving port provided in the main body side when the cartridge was mounted onto the main body of the image forming apparatus.

SUMMARY OF THE INVENTION

Therefore, an object of the present invention is to prevent toner from being scattered due to a user's opening, by mistake, a shutter of toner discharge port of a cartridge when he/she exchanges the cartridge.

In addition, another object of the present invention is to prevent the surface of the cartridge container from being polluted with toner at the time when the waste toner shutter is opened and closed.

In addition, another object of the present invention is to provide a cartridge that enables miniaturization.

In order to attain the above described objects, a cartridge has: a cartridge detachably mounted to an image forming apparatus is provided which comprises: removing means of removing toner on an image bearing member; a discharge port of discharging toner removed by said removing means; a shutter of opening and closing said discharge port; and a lock mechanism of unlockably locking said shutter.

Another cartridge of the present invention is a cartridge detachably mounted to an image forming apparatus having a shutter of opening and closing a toner receiving port, comprising: removing means of removing toner on an image bearing member; a discharge port of discharging toner removed by said removing means; a shutter of opening and closing said discharge port; and an engaging part engaged with said shutter of said image forming apparatus so that said shutter of said cartridge and said shutter of said image forming apparatus move in conjunction.

Another cartridge of the present invention is a cartridge detachably mounted to an image forming apparatus, comprising: a toner supply port of receiving toner supply; developing means of developing a latent image formed onto an image bearing member with toner supplied from said toner supply port; removing means of removing toner on an image bearing member; a discharge port of discharging toner removed by said removing means; a first shutter of opening and closing said discharge port; a second shutter of opening and closing said toner supply port; and an engaging part, provided in said image forming apparatus, to be engaged with opening/closing means of opening and closing said first and second shutters at a time when mounting of said cartridge onto said image forming apparatus is completed.

Another cartridge of the present invention is a cartridge detachably mounted to an image forming apparatus comprising: developing means of developing an electrostatic image formed onto an image bearing member with toner; and removing means of removing toner on an image bearing member, wherein said developing means implements development with toner supplied from outside said cartridge, and toner removed by said removing means is discharged outside said cartridge.

BRIEF DESCRIPTION OF THE DRAWING

FIGS. 12A and 12B are drawings for describing a configuration of driving the waste toner shutter lock;

DETAILED DESCRIPTION OF THE EMBODIMENT

Next, an embodiment related to the present invention will be described in detail with reference to drawings.

At first, a configuration of a cleaning apparatus as well as waste toner carrying means in an image forming apparatus in adaptation of electrophotographic technology of the present embodiment system will be described with reference to FIGS. 1 to 4A and 4B.

The present configuration is provided with a plurality of photosensitive drums arranged in a line corresponding with respective colors as an image forming apparatus in an electrophotographic system in a plurality of colors or in full color. And it is a so-called in-line type image forming apparatus that sequentially overlapping toner images in respective colors formed on respective photosensitive drums to form a color image.

Figure 1:
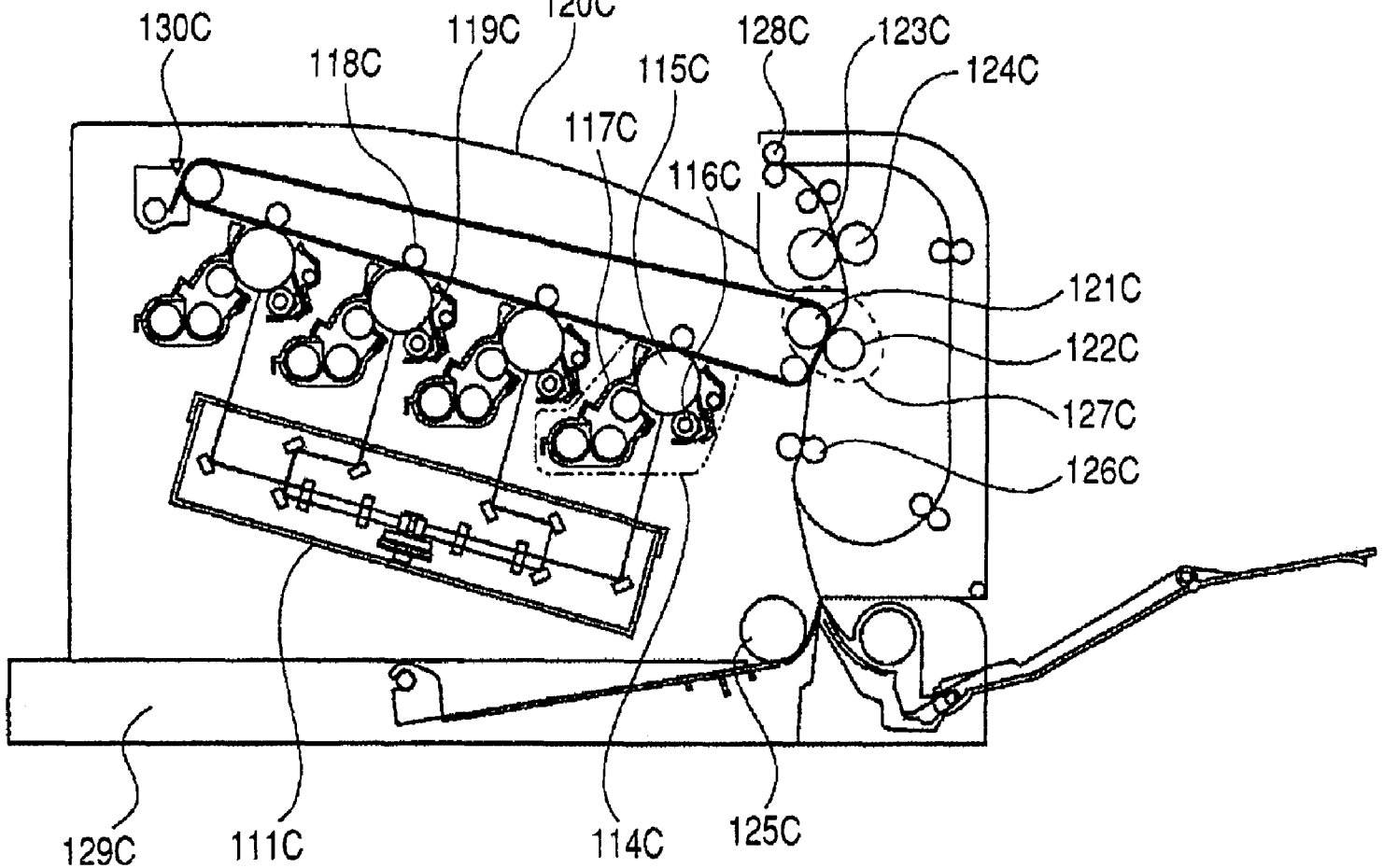
FIG. 1 is a sectional side view of an image forming apparatus to which the present invention has been applied.

At first, FIG. 1 is a sectional view of the present configuration. As for image forming, four process cartridges 114C disposed on a substantial horizontal straight line in a constant distance are provided, and respective images in yellow color, magenta color, cyangens color and black color are formed.

In the respective process cartridges 114C, drum type electrophotographic photosensitive members (hereinafter to be referred to as a photosensitive drum) 115C are installed. In the circumference of a photosensitive drums 115C, a primary charging apparatus 116C, a developing apparatus 117C, a transfer roller 118 as transfer means and a drum cleaner apparatus 119C are disposed. In addition, a laser exposure apparatus 111C is installed below and between the primary charging apparatus 116C and the developing means 117C.

Figure 2:
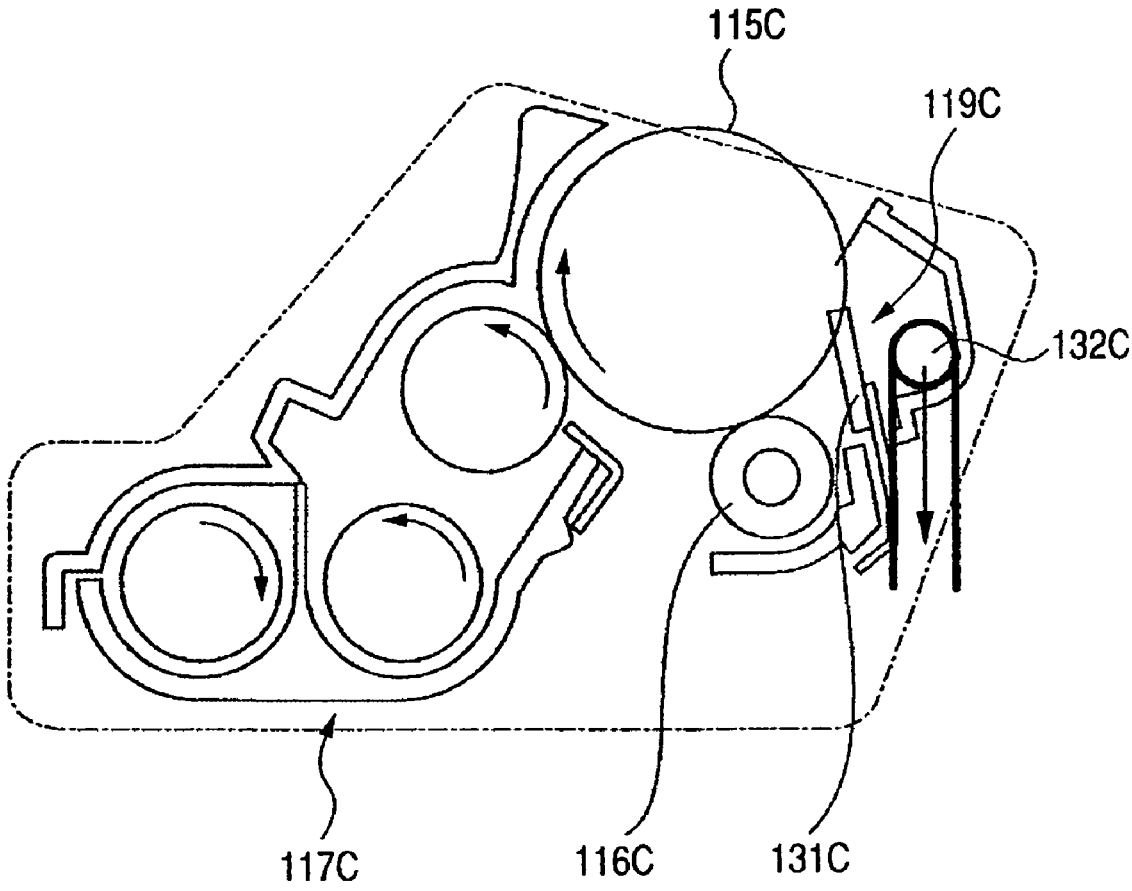
FIG. 2 is a sectional diagram of a process cartridge thereof.

With reference to FIG. 2, the interior of the process cartridge 114C as a cleaning container will be described in detail. The photosensitive drum 115C has a photoconductive layer on the drum base member being a negatively charged OPC photoconductive member and made of aluminum and is driven to rotate at a predetermined process speed with a driving apparatus (not shown in the drawing). The primary charging apparatus 116C as the primary charging means uniformly charges the surface of the photosensitive drum 115C to a predetermined negative potential by means of a charging bias applied from a charging bias power supply (not shown in the drawing).

The developing apparatus 117C retains toner internally and causes toner in respective colors to be stuck onto respective electrostatic latent images formed on respective photosensitive drums 115C to be developed (visualized) as toner images.

And the transfer roller 118C shown in FIG. 1 as the primary transfer means is disposed inside an intermediate transfer belt unit 120C and is disposed so as to be urged toward the photosensitive drum 114C.

The drum cleaner apparatus 119C has a cleaning blade etc. for removing, on the photosensitive drum 114C, transfer residual toner remaining after the primary transfer on the photosensitive drum 115C.

The intermediate transfer belt unit 120C comprises a drive roller 121C to simultaneously operate as a secondary transfer opposite roller, a gear on the drive roller shaft, that is not shown in the drawing, and is driven to rotate by a drive gear on the main body that is not shown in the drawing either. The drive roller 121C is disposed so as to face the secondary transfer roller 122C.

In addition, at the downstream side in a conveying direction of the transfer material T in the secondary transfer roller 122C, a fixing apparatus having a fixing roller 123C and a pressure roller 124C is installed in a vertical path configuration.

The exposure apparatus 111C is configured by laser emitting means of implementing emission corresponding with chronological electric digital pixel signals in given image information, a polygon mirror and a reflection mirror etc. In addition, applying exposure to the respective photosensitive drums 115C, electrostatic latent images corresponding with image information onto the surface of the respective photosensitive drums 114C charged by respective primary charging apparatuses 116C.

The toner image formed with such an image forming apparatus is transferred onto the transfer material T in a secondary transfer part 127C subject to application of resist correction to the transfer material T, which is separated into a single sheet with the sheet feeding roller 125C inside a sheet feeding apparatus 129C with a resist roller 126C. In addition, the transfer material T undergoes heating/pressing with the fixing apparatus and discharged from the paper output roller 128C.

Next, a toner circulation configuration will be described based on FIGS. 3 and 4.

Figure 4A:
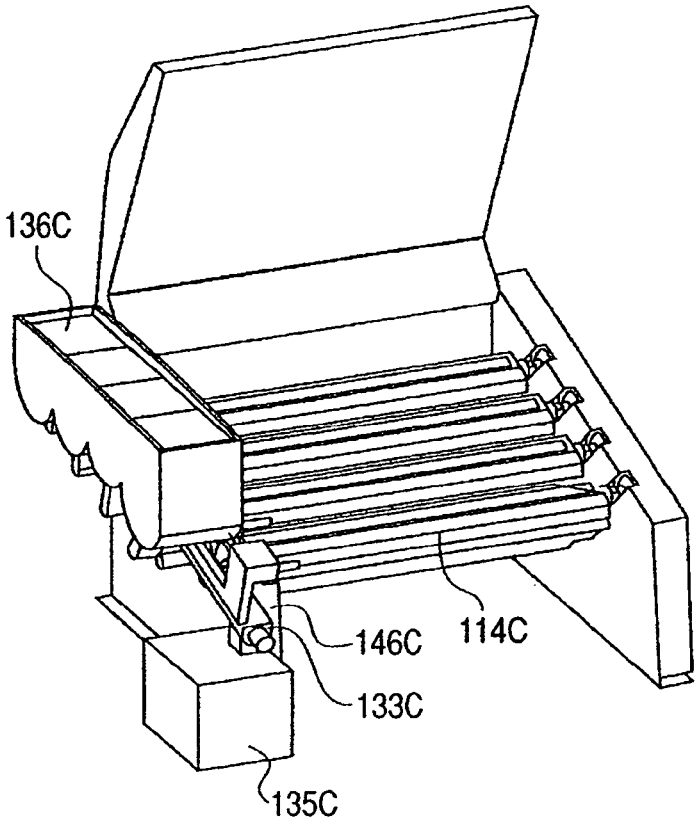
FIGS. 4A and 4B are drawings for describing a circulation configuration of toner.
Figure 4B:
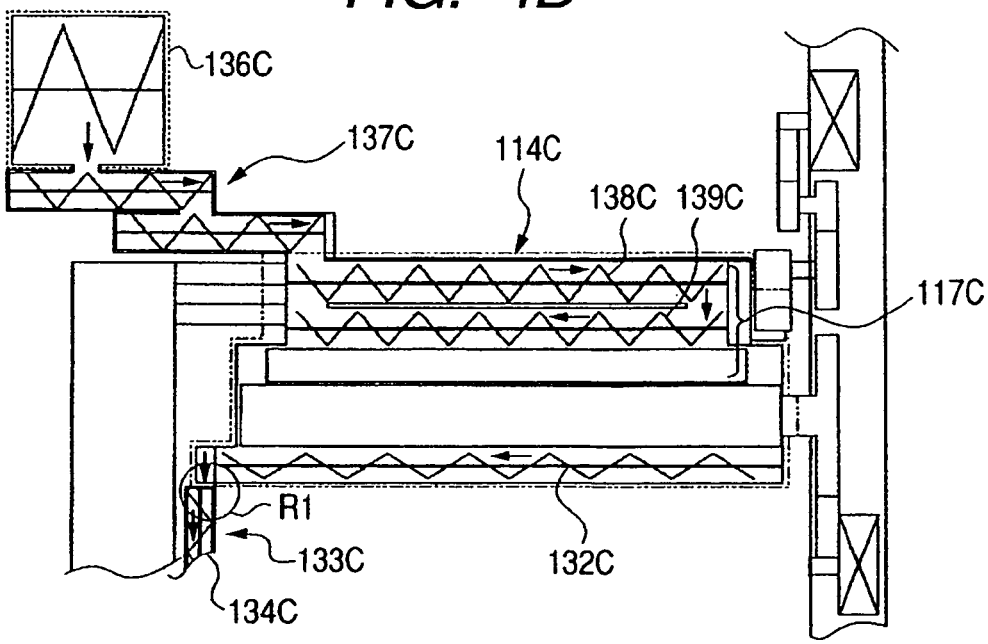

At first, in FIGS. 4A and 4B, toner supplied from the toner cartridge 136C is supplied to the process cartridge 114C in a predetermined amount with quantitatively supplying (or replenishment) means 137C. In the process cartridge 114C, two carrying screws (138C and 139C) in a developing chamber 117C agitate toner and supply (or replenish) the toner to the photosensitive drum 115C from the developing sleeve 140C. And the toner on the photosensitive drum 115C is transferred onto the intermediate transfer belt.

In the above described configuration, as shown in FIG. 1, it is difficult to bring all the toner subject to development onto the surface of the photosensitive drum 115C into complete transfer to the transfer belt, and in addition, it is also difficult to bring the toner on the transfer belt into complete transfer, and therefore it is inevitable that a part of toner is left on the surface of the photosensitive drum 115C and the transfer belt 120C.

Therefore, sufficient cleaning prior to the start of the next image forming process will become an indispensable requirement for deriving an image of quality, and therefore a drum cleaning apparatus 119C is provided so as to be located adjacent to the photosensitive drum 115C and a belt cleaning apparatus 130C is provided so as to be located adjacent to the transfer belt respectively. As for details of the drum cleaning apparatus 119C, the one configured by bringing a cleaning blade 131C made of a resilient member such as urethane rubber as removing means into contact with the surface of the photosensitive drum 114C to remove the residual toner is simple in configuration as well as compact and is excellent in toner removing function, and therefore has been widely used conventionally. This configuration comprising this blade is likewise in the belt cleaning means.

Figure 3:
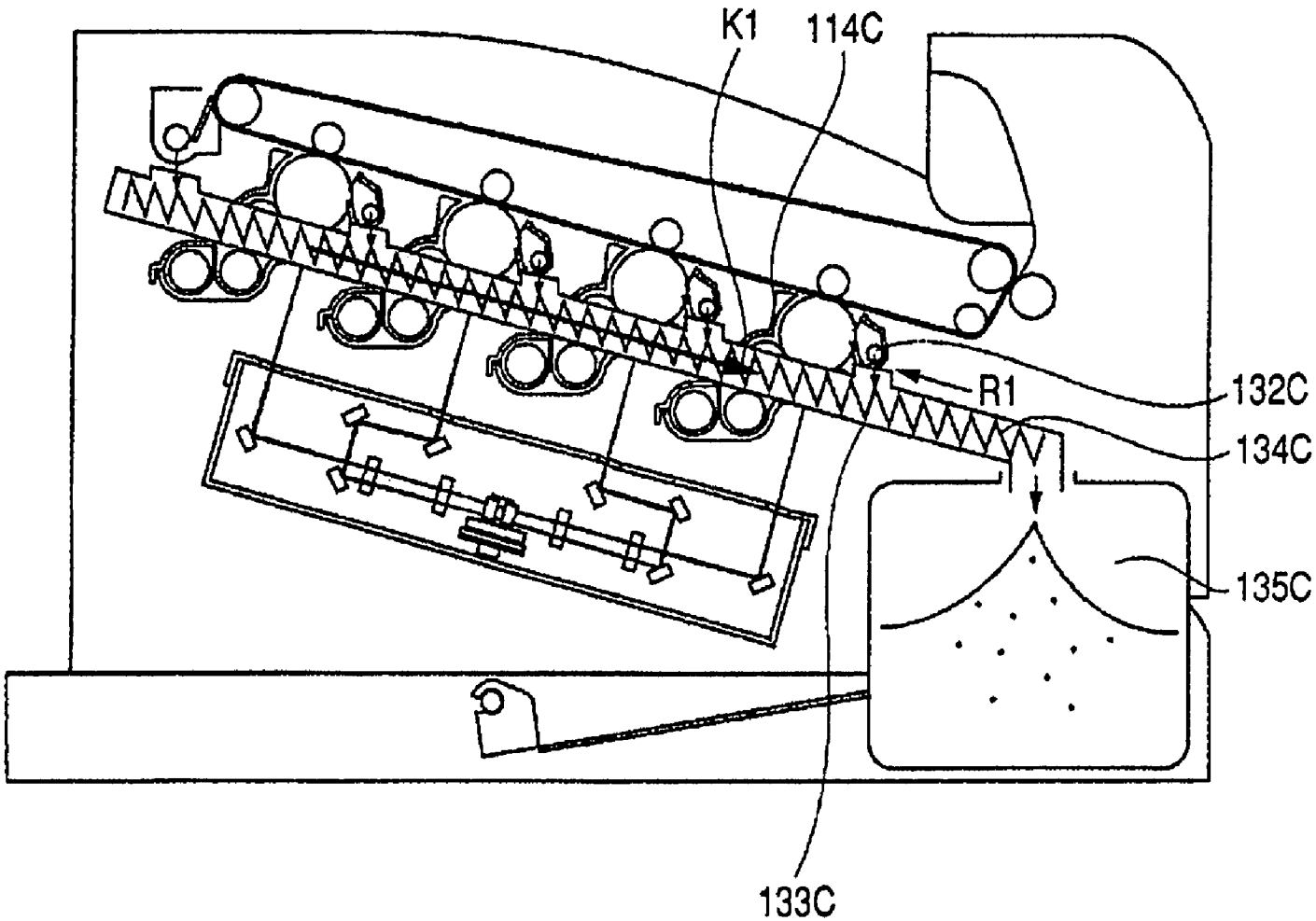
FIG. 3 is a side sectional diagram of the image forming apparatus to which the present invention has been applied.

The waste toner retrieved by the drum cleaning apparatus 119C through such an image forming process is carried to outside the cleaning apparatus, that is, outside the process cartridge 114C with the first carrying screw 132C as in FIG. 3, and is delivered as waste toner to the waste toner carrying apparatus 133C in the main body side of the apparatus at R1.

The waste toner carrying apparatus 133C refers to a carrying path of carrying waste toner discharged from the belt cleaner apparatus 130 C as well as four drum cleaner apparatuses 119C to the right direction of the main body of the apparatus, and the second carrying screw 134C is disposed rotatably inside the waste toner carrying apparatus and is driven to rotate in the →K1 direction. A waste toner housing apparatus 135C is disposed at the end part at the tip in the carrying direction of the waste toner carrying apparatus 133C and is configured so as to retrieve all the waste toner to its inside.

Next, a shutter lock configuration as opening/closing means of the toner delivery part being a feature of the present configuration will be described with reference to FIGS. 5A and 5B to 8.

Figure 5A:
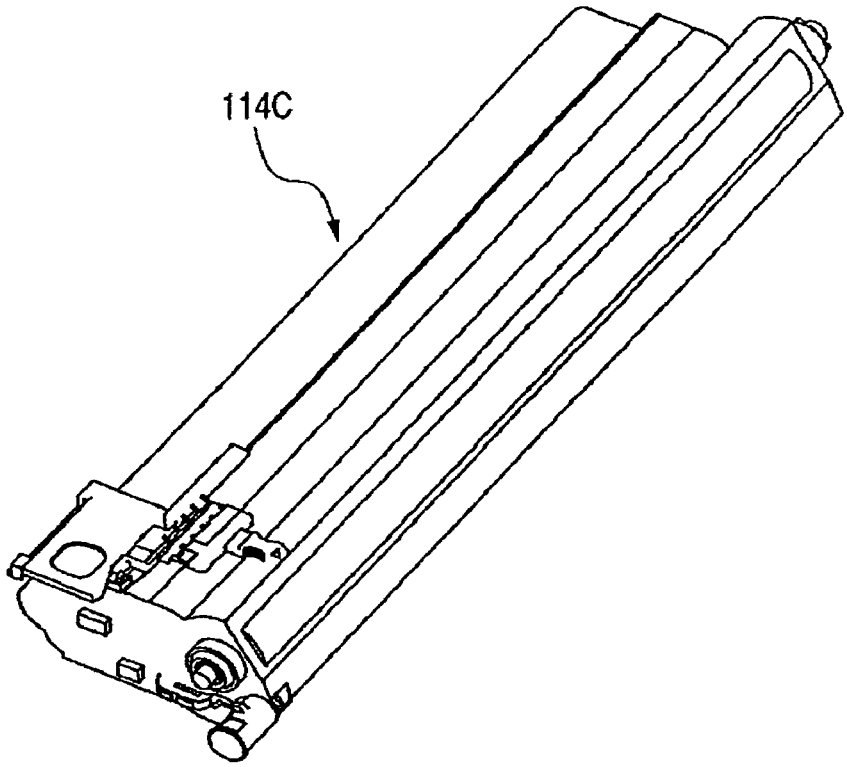
FIGS. 5A and 5B are perspective views of the process cartridge.
Figure 5B:
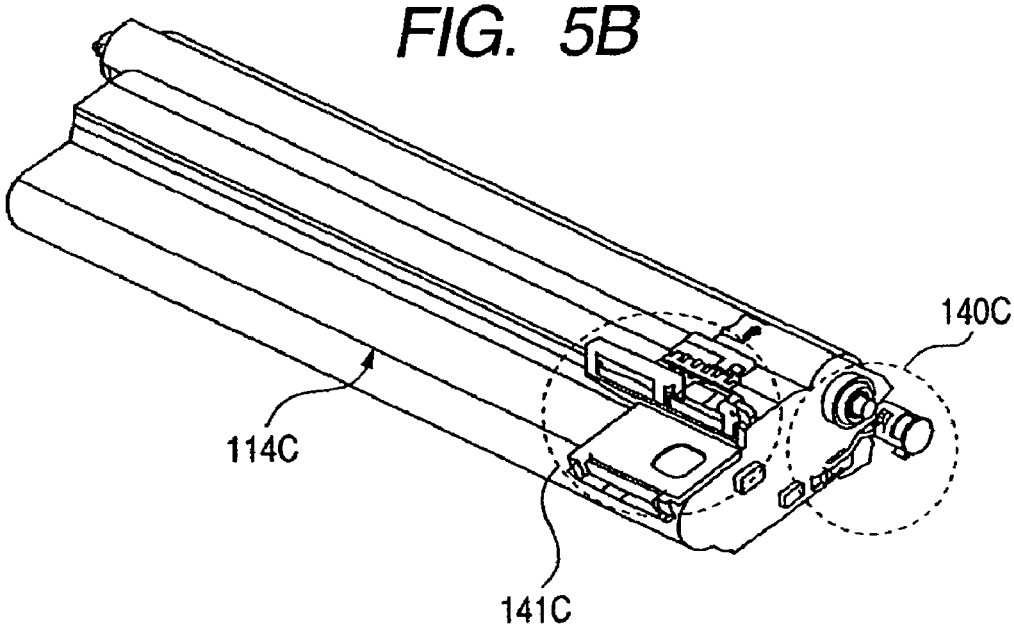

At first, FIGS. 5A and 5B are perspective views of the process cartridge, wherein, a waste toner shutter mechanism 140C as opening/closing means to open and close the delivery part of delivering toner and a supply shutter mechanism 141C are disposed.

Figure 6A:
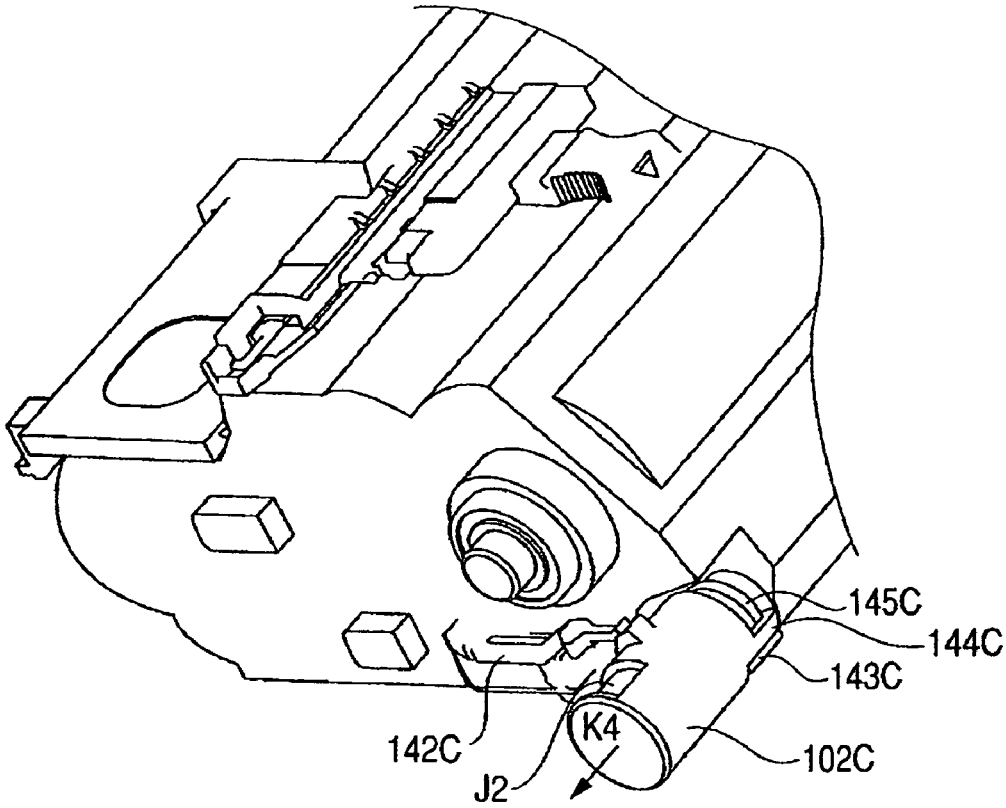
FIGS. 6A and 6B are drawings for describing a configuration of a waste toner shutter.
Figure 6B:
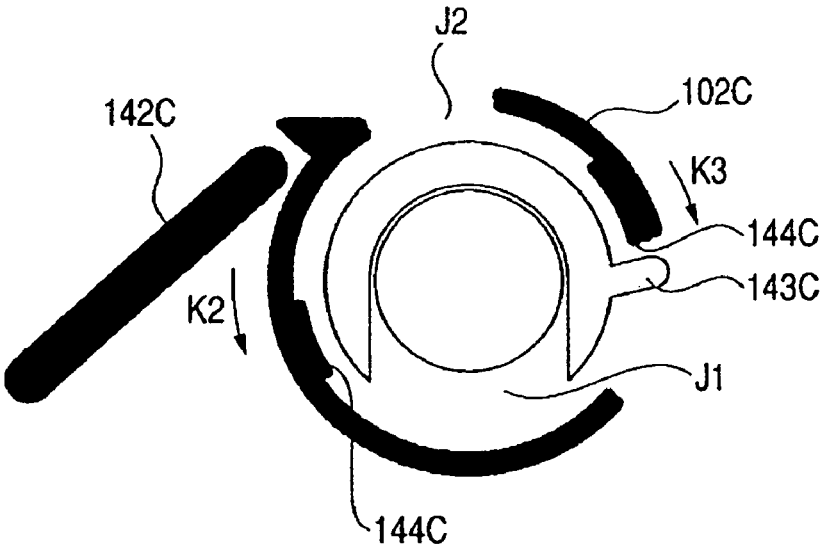

The waste toner shutter mechanism is configured as in FIGS. 6A and 6B to stop the discharge port shutter 102C as an opening/closing member from rotating in the K2 direction and to be capable of no rotation in the K3 direction with a protrusion 143C provided in an enclosure. Therefore, if a user tries to rotate the first shutter by mistake, no rotation occurs, and therefore an orifice J1 (toner discharge port) of the process cartridge 114C and an orifice J2 of the discharge port shutter 102C will not be connected. In addition, a claw 144C provided in the discharge port shutter 102C is engaged with the protrusion 145C of the cartridge enclosure so that the discharge port shutter 102C will not be removed in the K4 direction either but is a reliable shutter lock configuration.

Next, a method of unlocking this lock mechanism will be described with reference to FIGS. 7A to 7C.

Figure 7A:
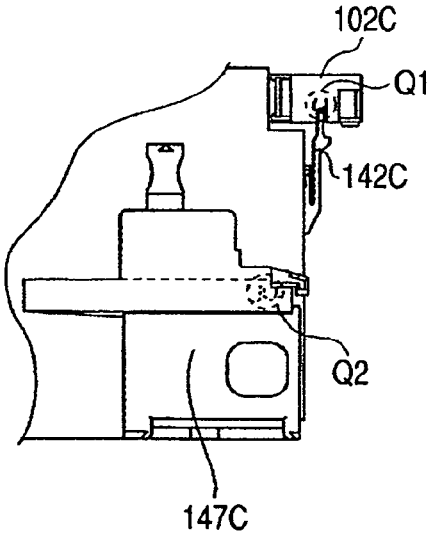
FIGS. 7A, 7B and 7C are drawings for describing a configuration of unlocking a waste toner shutter lock.
Figure 7B:
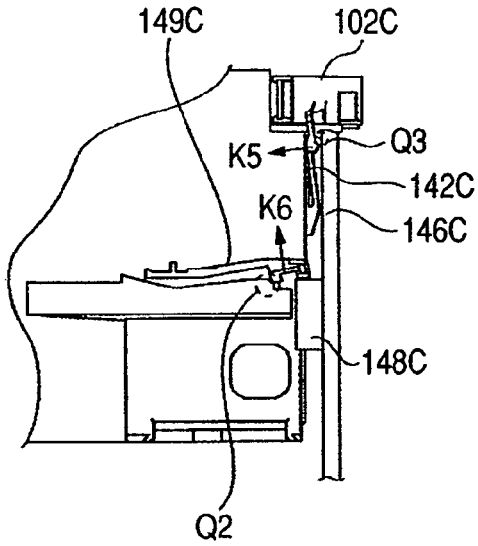
Figure 7C:
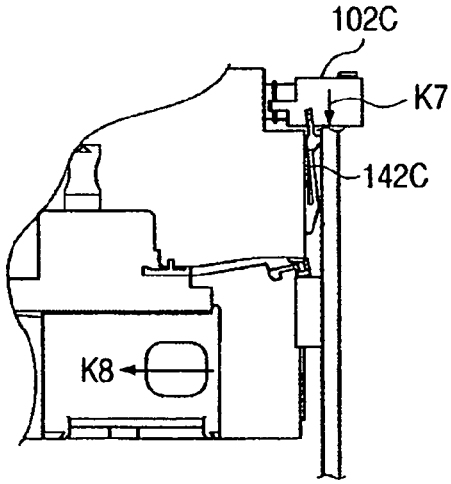
Figure 8:
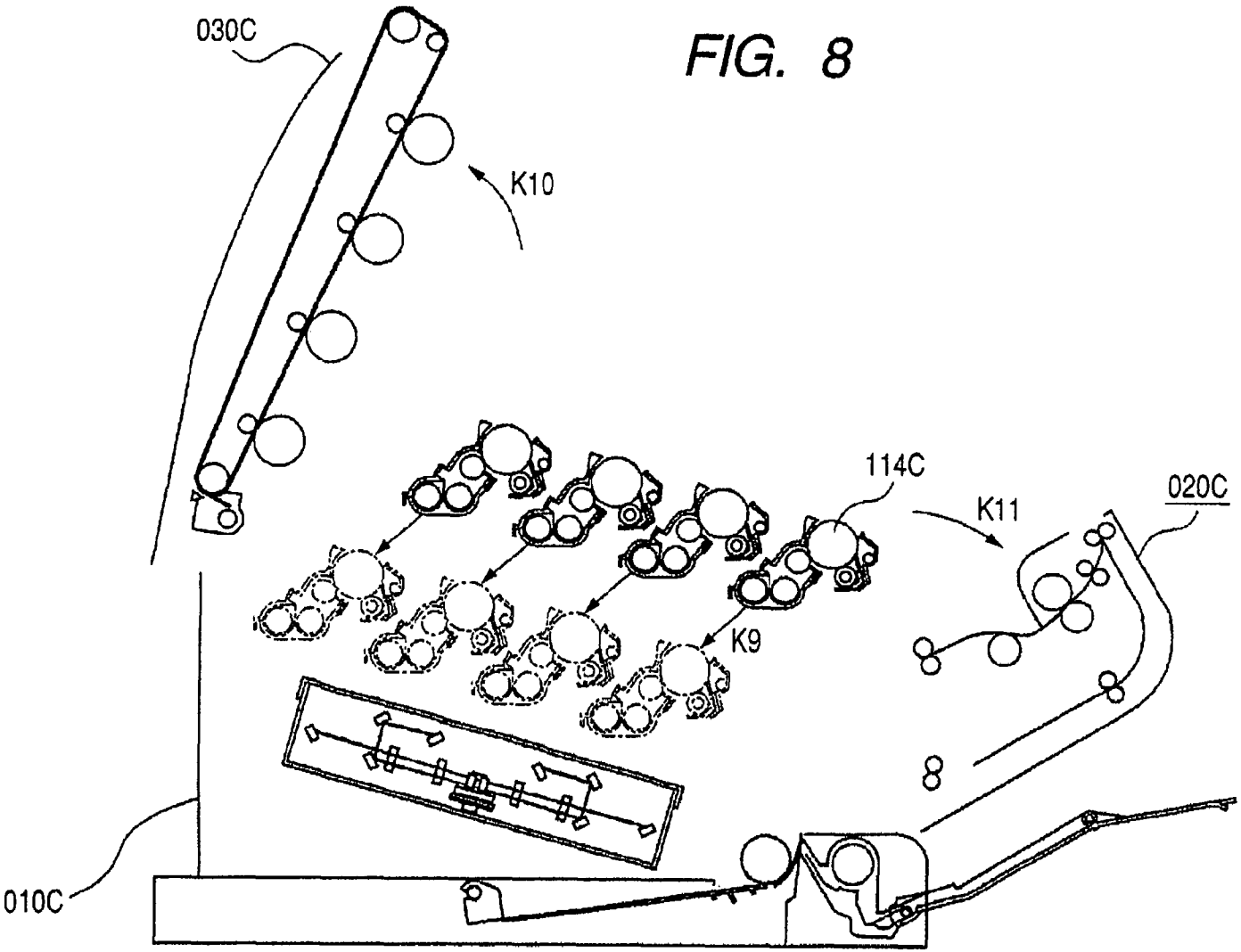
FIG. 8 is an explanatory drawing how to mount the process cartridge thereon.

FIG. 7A shows a process cartridge 114C prior to setting to the main body apparatus, wherein the discharge port shutter 102C and the supply shutter 147C for supplying toner are locked at the portions Q1 and Q2. This process cartridge 114C is set to the main body (is disposed (mounted onto) in a predetermined location to face without relative movement to face the toner delivery part (toner delivery port) J4 in which the toner discharge port is provided corresponding with the main body of the apparatus), and then as in FIG. 7B, the main body frame 146C and the shutter lock member 142C are brought into contact at the portion Q3 so that the shutter lock member 142C moves in the K5 direction and the lock at the portion Q1 is unlocked.

In addition, in the supply side, the toner supply port (not shown in the drawing) of the supply container in the side of the main body of supplying toner to the cartridge and the toner supply receiving port (not shown in the drawing) of the cartridge are disposed (mounted) in a predetermined location to face without relative movement, and then a shutter lock member 149C of locking opening and closing operations of the shutter of the toner supply port will contact the unlocking member 148C provided in the main body to move in the K6 direction to unlock the lock in the portion Q2. This will enable the discharge port shutter 102C and the supply shutter 147C to open and close, to transmit drive of moving the shutter as in FIG. 7C to enable thereby the discharge port shutter 102C in the K7 direction to enable the supply shutter 147C to move in the K8 direction to enable connection to the orifice in the main body side.

In addition, the configuration brings the shutter provided in the discharge port of the cartridge into engagement with the shutter provided in the toner receiving port side in the main body side when the cartridge is mounted to the main body of the apparatus and causes the shutter provided in the main body side to receive the drive of the main body to open the shutter of the cartridge. In addition, the configuration brings the shutter of the toner supply port in the main body side and the shutter of the supply receiving port of the cartridge into engagement to cause the shutter provided in the main body side to receive the drive of the main body to open thereby the shutter of the cartridge. Here, in the case where a user drives the shutter manually, drive transmission is implemented in the other way around unlike the above described case, and it is advisable that the user etc. drives a shutter in the cartridge side to drive the shutter in the main body side in engagement with the shutter in the cartridge side.

In addition, the cartridge supply receiving port and the discharge port are provided in the same side in a longitudinal direction of the cartridge so as to limit disposition of the drive source to only one side of the main body of the apparatus to simplify the configuration to make it possible to plan cost reduction.

Such unlocking of a lock can be implemented by opening the first door 020C and the exchange door 030C to the main body apparatus 010A in the K10 and K11 directions, and moving the process cartridge 114C in the K9 direction to be set to the main body apparatus 010C.

Thus, it will become feasible to prevent without fail the delivery port from scattering toner at the time of detachment and attachment of the process cartridge since the shutter member is opened/closed after the toner delivery port of the process cartridge and the delivery port in the main body side corresponding with it are mounted thereon.

Subsequently, a configuration that the first shutter of the waste toner shutter mechanism having undergone unlocking of the lock rotates will be described with reference to FIGS. 9A to 12B.

Figure 9A:
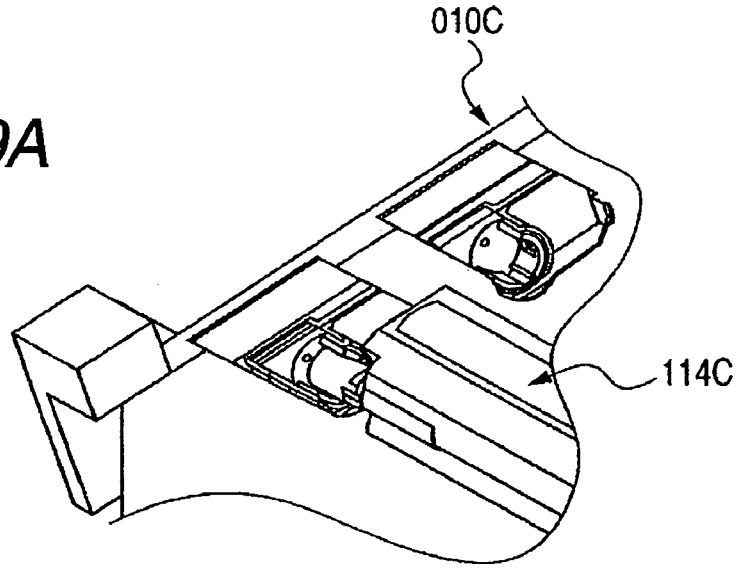
FIGS. 9A, 9B and 9C are drawings for describing a configuration of a waste toner shutter.
Figure 9B:
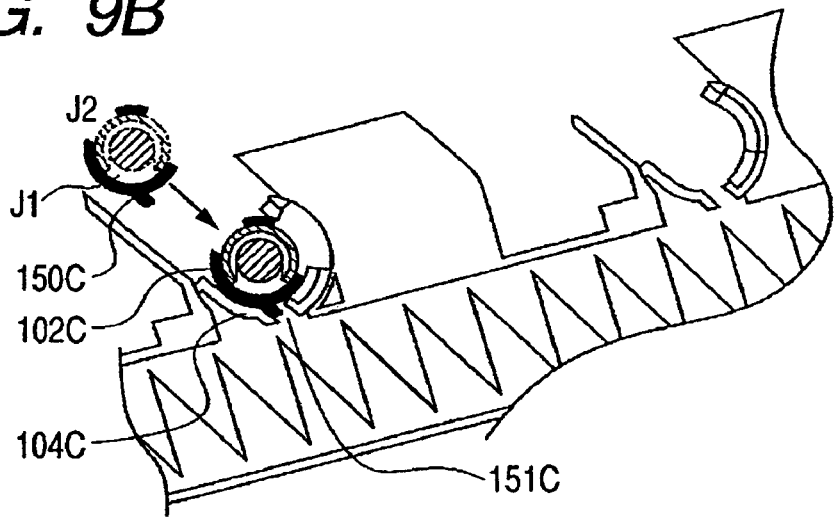

The process cartridge 114C set to the main body apparatus 010C in FIG. 9A comprises a protrusion 150C of the discharge port shutter 102C in the side of the process cartridge 114C as in FIG. 9B and the cavity 151 (fitting part or engaging part) provided in the main body shutter 104C in the main body apparatus side are brought into fitting (engagement) to enable the discharge port shutter 102C and the main body shutter 104C to rotate integrally. And, transmitting the drive for the protrusion 150C of the discharge port shutter 102C as a drive transmitting part to rotate the shutter, rotation in the K12 direction is derived so as to bring the orifice J1 of the process cartridge, the first shutter orifice J2, the orifice J3 of the main body shutter and the orifice J4 of the waste toner carrying apparatus 133C (delivery part) into communication to enable delivery of waste toner.

Figure 10A:
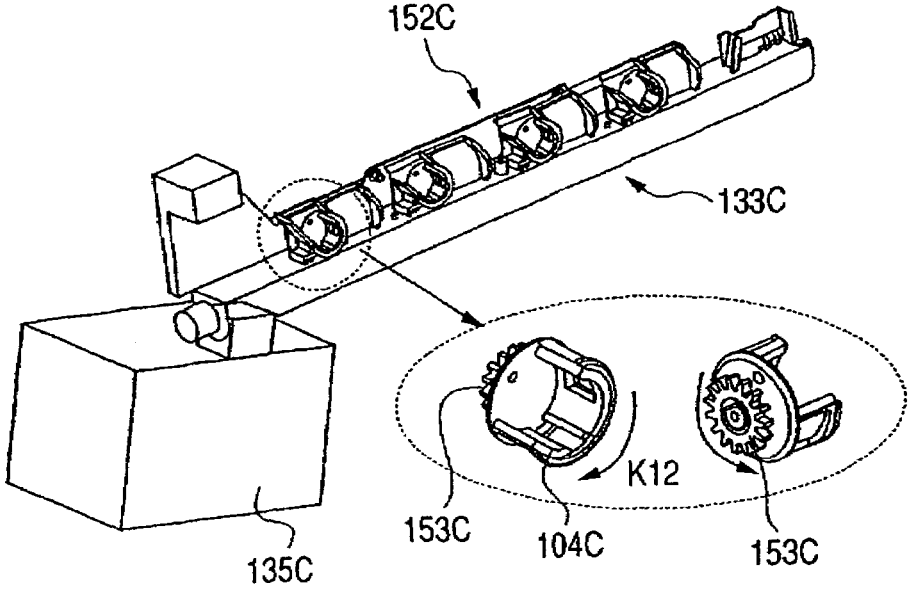
FIGS. 10A, 10B and 10C are drawings for describing a configuration of driving the waste toner shutter lock.
Figure 10B:
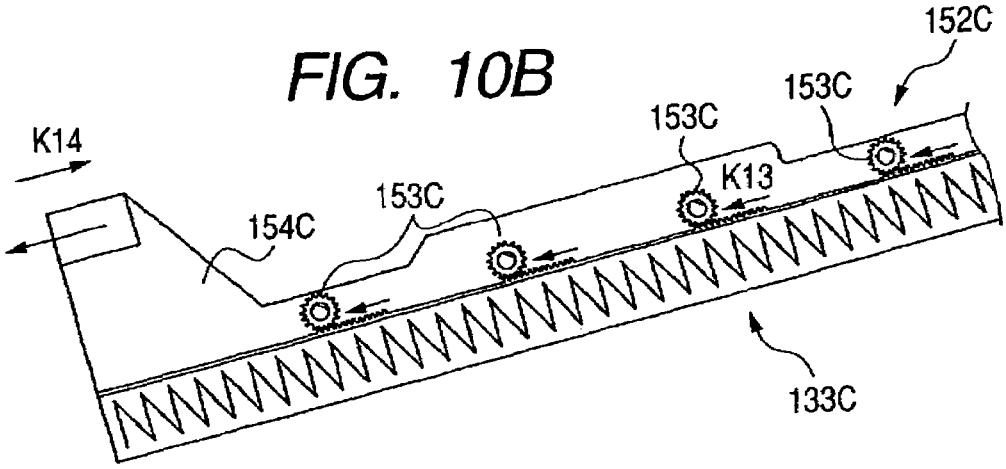
Figure 10C:
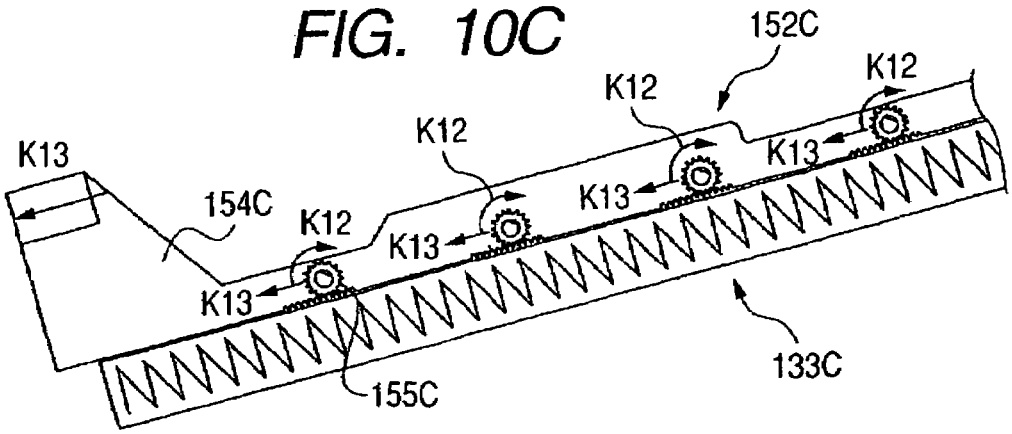

At first, drive means 152C of moving this shutter is provided with a manual drive on the waste toner carrying apparatus 133C as in FIGS. 10A to 10C, a movement of an opening/closing lever 154C in the→K13 direction for the gears 153C in connection with the main body shutter 104C in the main body side is configured to cause the rack teeth 155C as a drive transmission part provided in the opening/closing lever as in FIG. 10C to rotate the main body shutter 104C in the K12 direction via the gears 153C. In addition, at the time when the shutter is returned, movement in the K14 direction is configured to rotate it in the opposite direction.

Figure 11A:
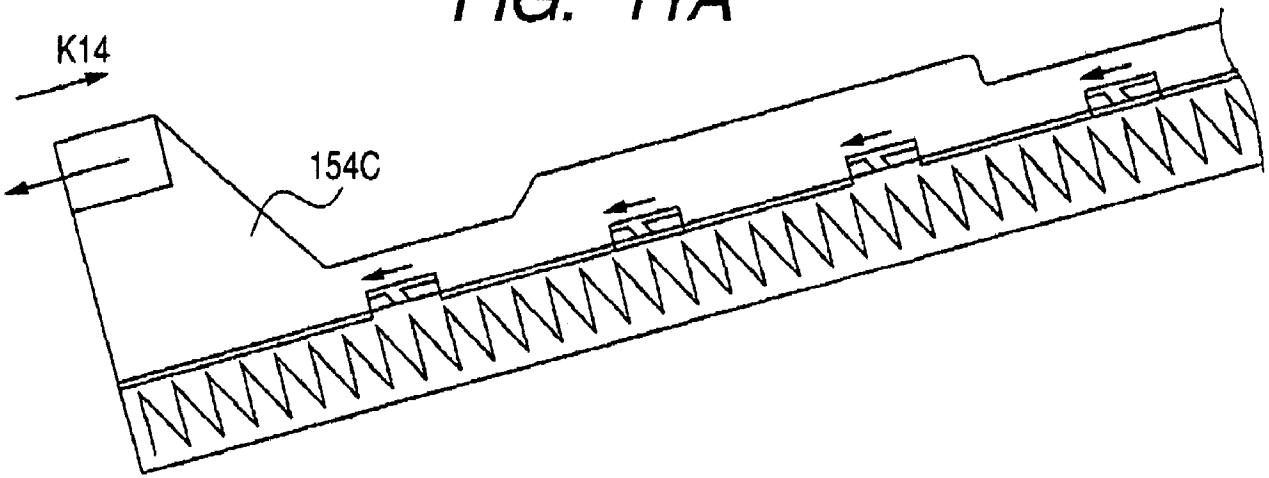
FIGS. 11A and 11B are drawings for describing a configuration of driving the waste toner shutter lock.
Figure 11B:
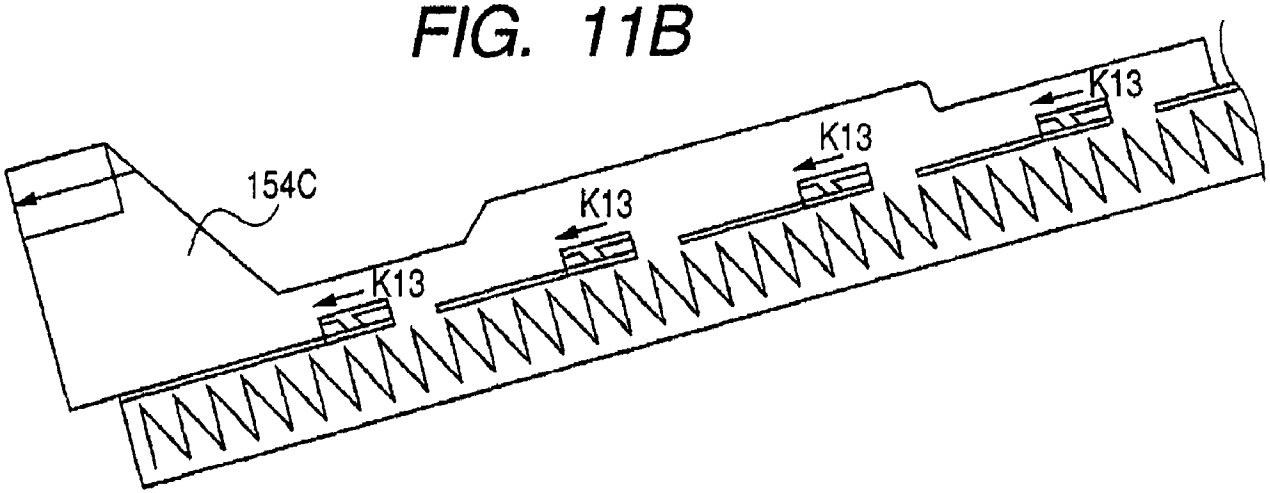

In addition, the above described case relates to a configuration for the shutter to rotate, but as in FIGS. 11A and 11B, the shutter configuration corresponding with operations (in the K13 and K14 directions) of the opening/closing lever 154C also derives a likewise effect.

Figure 12B:
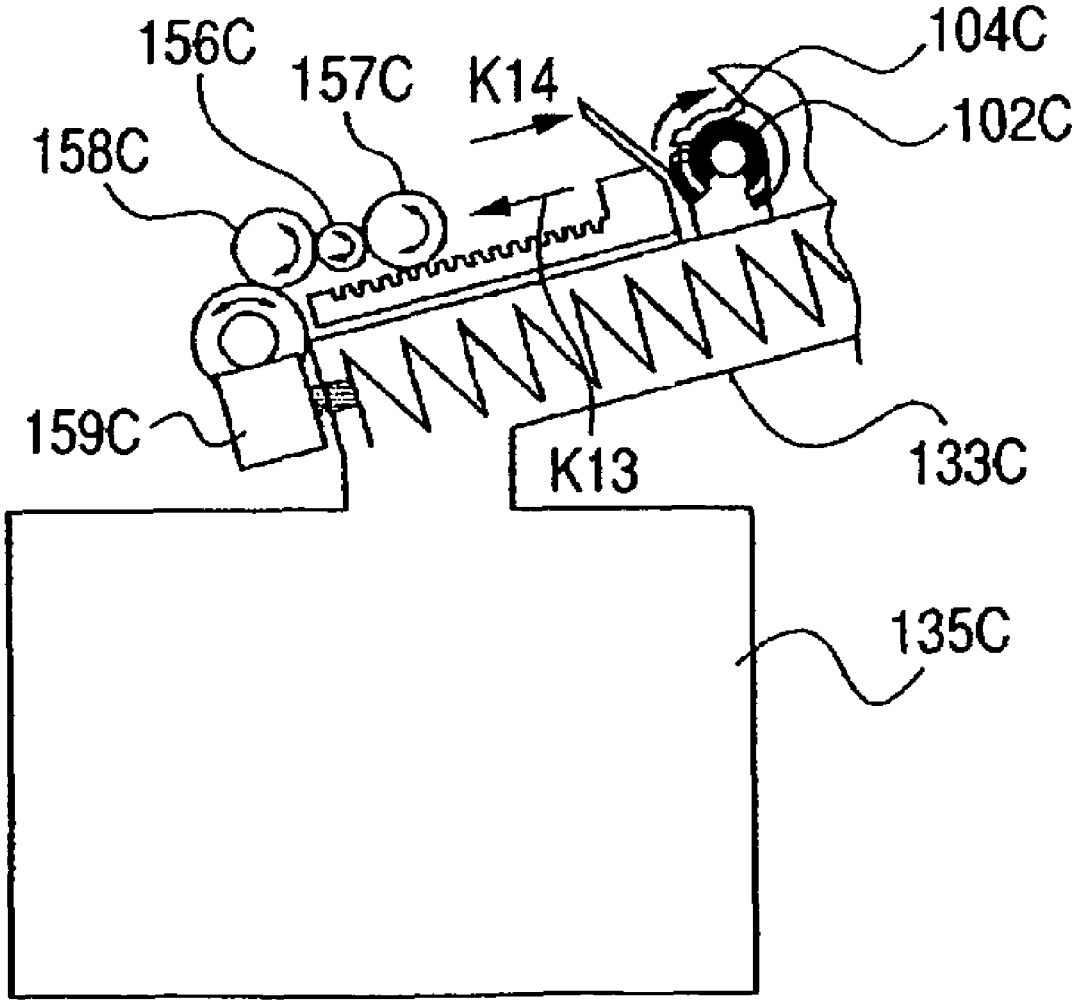

Next, the case of using a motor provided with drive transmission in the main body apparatus will be described with reference to FIGS. 12A and 12B.

The waste toner motor 155C of driving the waste toner carrying apparatus 133C operates to cause the first gear line (156C and 157C) to operate so that the opening/closing lever moves in the K13 and K14 directions to open and close the shutter (102C and 104C). Here, the present configuration has used the waste toner motor, but any motor such as sheet feeding motor etc. disposed in the main body apparatus derives the same effect. And the motor implements operations of opening the shutter subject to confirmation that the process cartridge has been set.

Figure 13A:
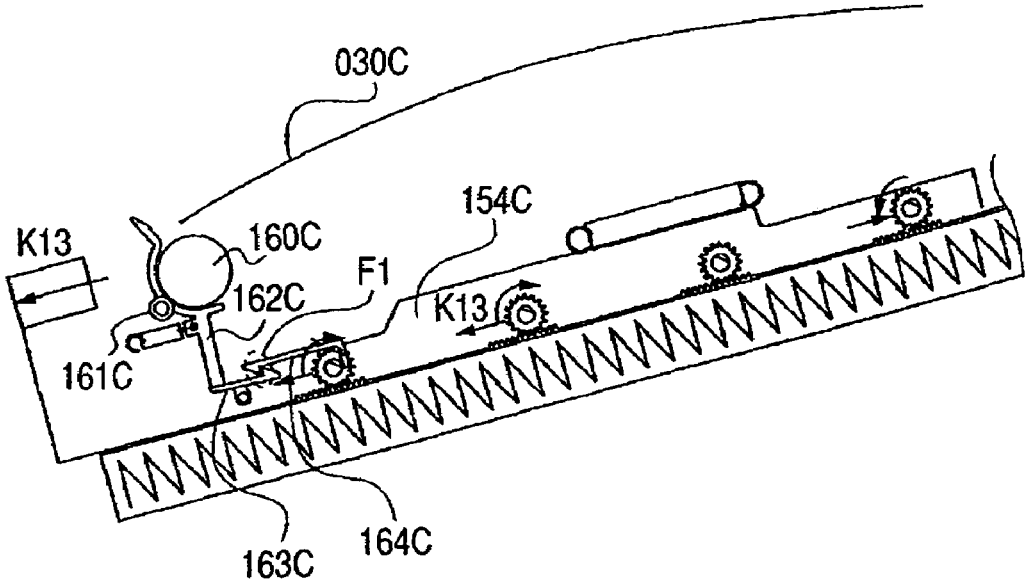
FIGS. 13A and 13B are drawings for describing a configuration of driving the waste toner shutter lock.
Figure 13B:
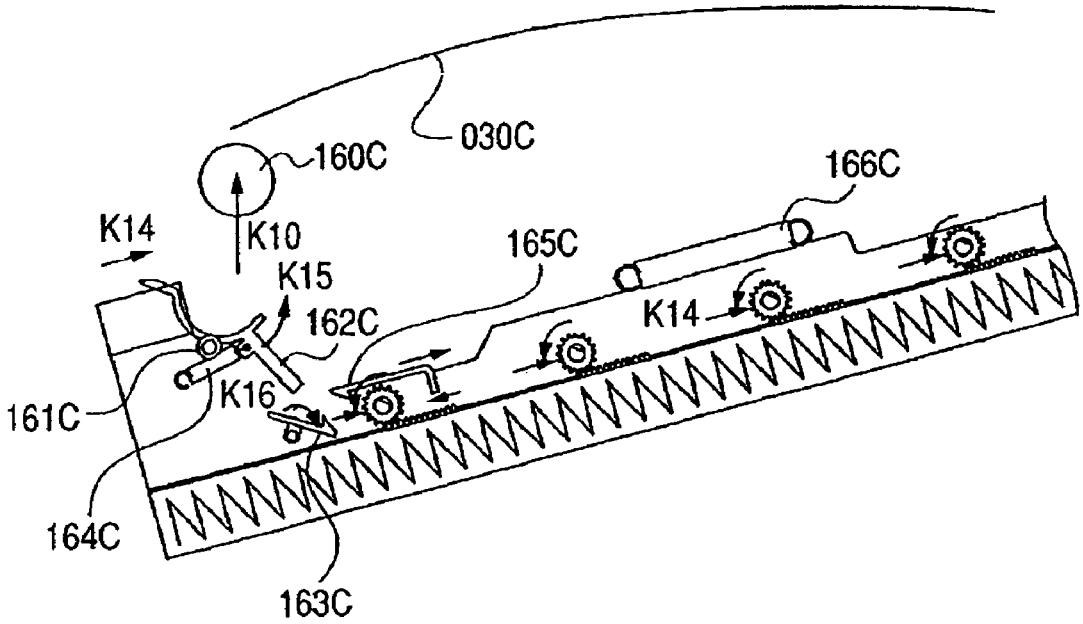

In addition, FIGS. 13A and 13B describe a configuration of using manual operation or a drive motor for an operation to open the shutter and of automatically closing the shutter when the exchange door is opened in the K10 direction at the time of closing the shutter, that is, at the time of removing the process cartridge 114C. As a mechanism, closure of an exchange window 030C as in FIG. 13A causes the holding member 160C to push a link 162C supported by a supporting shaft 161C and causes this link 162C to push the first lock member 163C, and applies a drive to the opening/closing lever 154C to move the opening/closing lever 154C in the K13 direction, to cause a second lock member 165C provided in the opening/closing lever 154C to lock and hold, with the first lock member 163C and the portion F1, the opening/closing lever 154C to be prevented from moving. And, the exchange window 030C opens as in FIG. 13B and then the holding member 160C evacuates, the link 162C evacuates in the K15 direction with the power of a spring 164C, in conjunction therewith, the first lock member 163C moves in the K16 direction, locking of the first lock member 163C and of the second lock member 165C is unlocked, the opening/closing lever 154C moves in the K14 direction with the power of a spring 166C to close the shutter and removal of the process cartridge will become feasible just by operation of opening the exchange door.

Figure 14A:
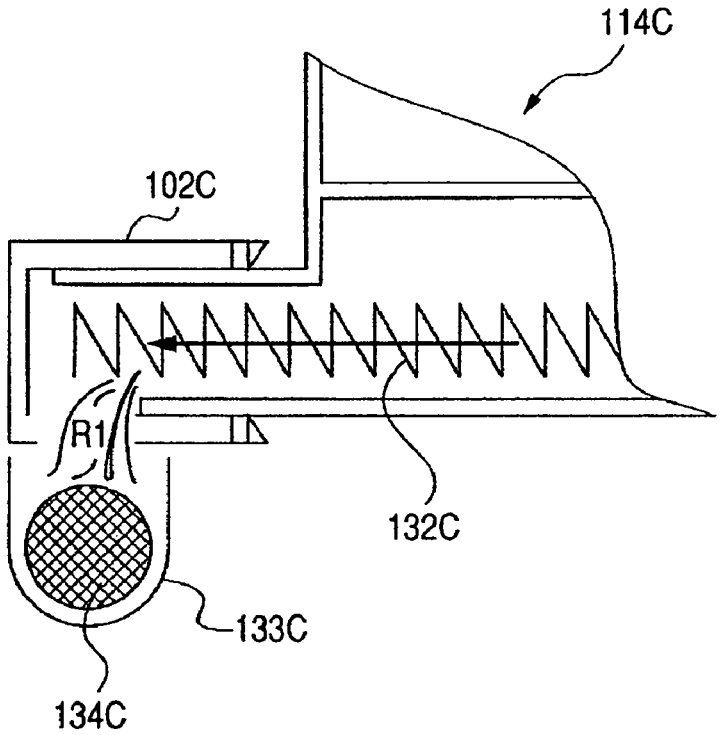
FIGS. 14A and 14B are drawings for describing a configuration of circulating waste toner.
Figure 14B:
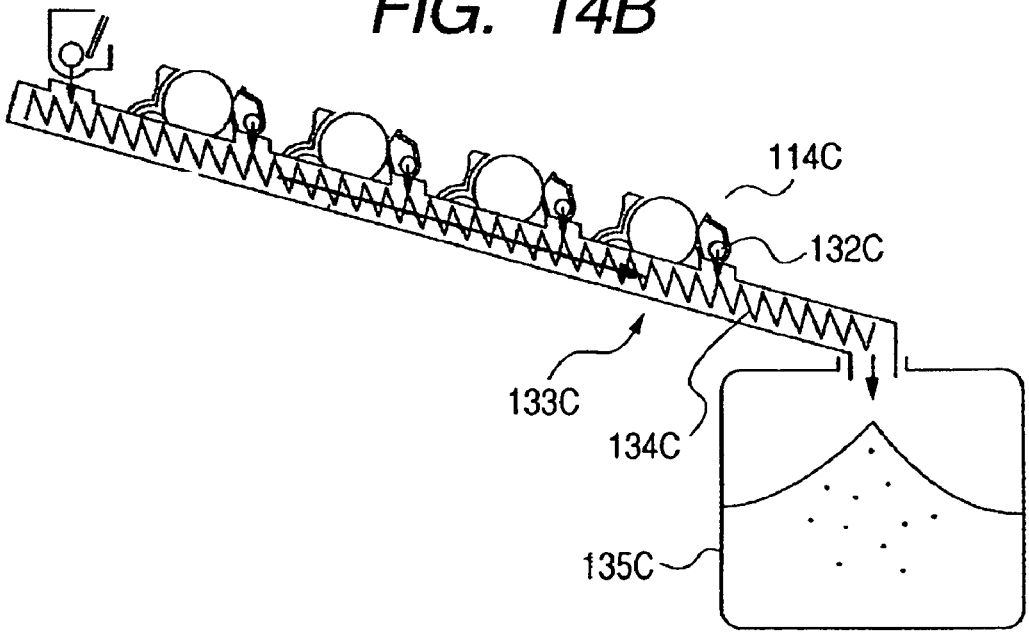

Thus, the waste toner shutter is opened, and in a state that the process cartridge and the orifice of the waste toner carrying apparatus are brought into communication, the carrying screw 132C inside the process cartridge 114C is driven as in FIGS. 14A and 14B, the waste toner inside the process cartridge is delivered to the waste toner carrying apparatus 133C at the orifice in connection at the portion R1 and carried to the waste toner housing container through the carrying screw 134C inside the waste toner carrying apparatus 133C.

Figure 9C:
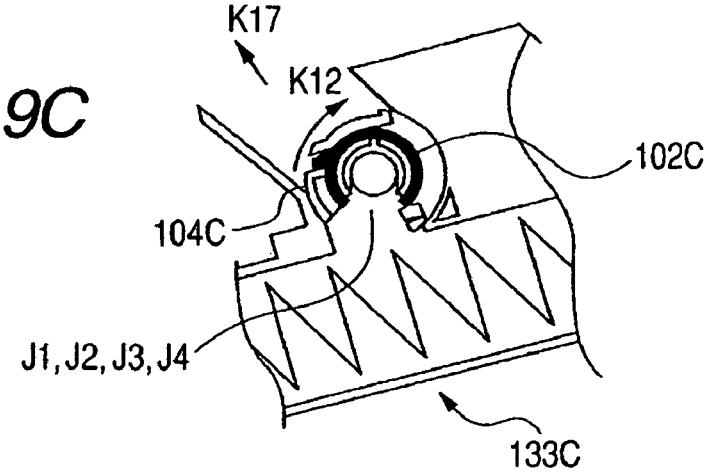
Figure 15C:
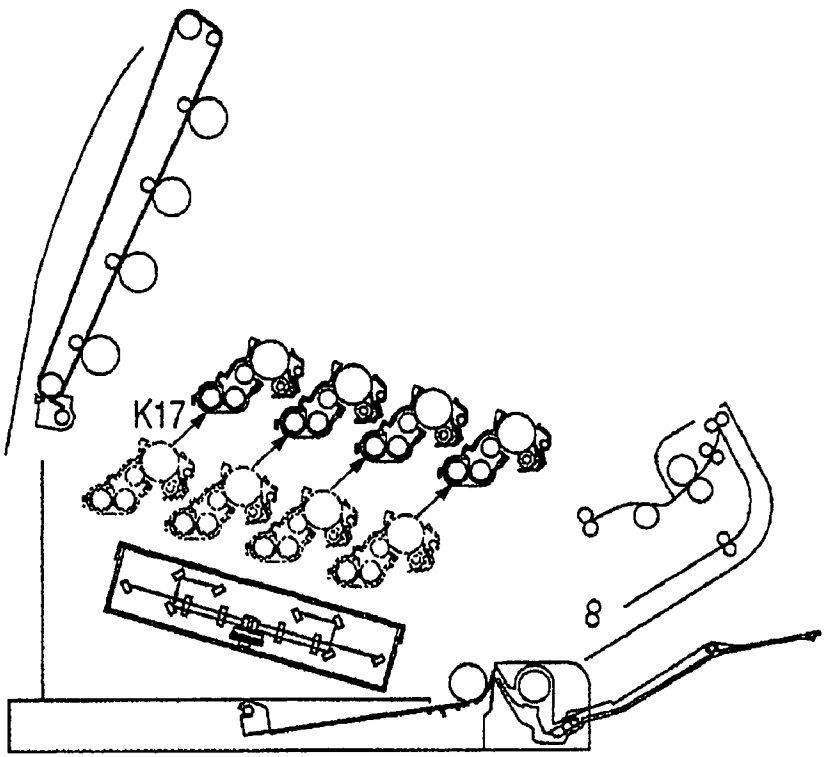
FIGS. 15A, 15B and 15C are drawings for describing a configuration of circulating waste toner.
Figure 15A:
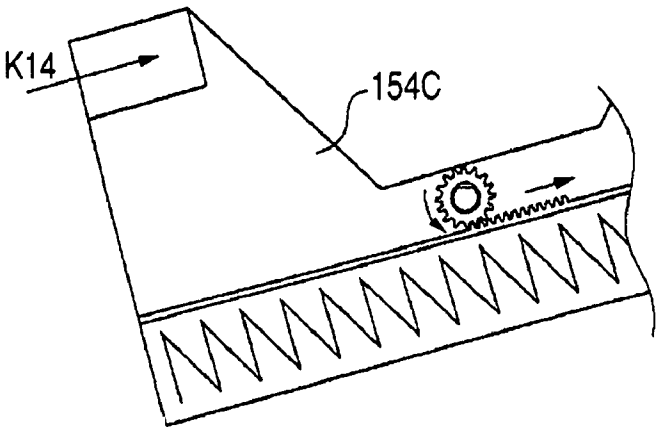
Figure 15B:
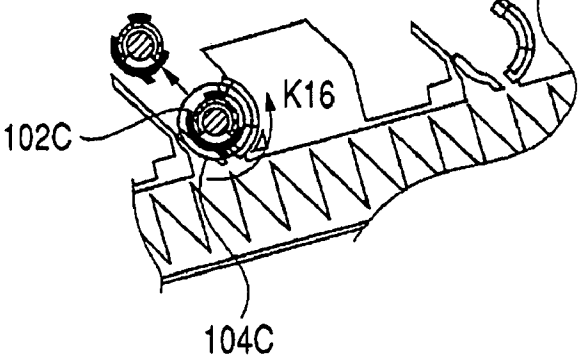

And, at the time when the process cartridge 114C is removed, the opening/closing lever 154C moves in the K14 direction as in FIGS. 15A and 15B, the main body shutter 104C and the discharge port shutter 102C rotate in the K16 direction through the rack 155C to the gear 153C and the process cartridge can be taken out in a state that the shutter member is completely closed as in FIG. 15C. Here, employment of the shutter configuration in the rotary system in use of the present configuration will cause no waste toner to leak since the main body shutter 104C in the side of the main body apparatus, as shown in FIG. 9C, blocks off removal of the process cartridge 114C in the K17 direction to make it impossible to remove the process cartridge if someone tries to remove it by mistake without closing the shutter. In addition, also a configuration of carrying waste toner from the process cartridge directly to the waste toner housing container can likewise prevent waste toner leakage by employing the shutter configuration of the present configuration. Moreover, besides the process cartridge it can also be used for the waste toner shutter on the intermediate transfer belt.

As described above, the present embodiment system can prevent scatter of waste toner from waste toner shutter due to image forming apparatus detachment/attachment as a result of opening/closing the shutter after the shutter of waste toner discharged from the cleaning container (process cartridge) is set at a predetermined location in the main body of the image forming apparatus and can achieve, by far, image quality stability and improvement in operability for users.

In addition, in the present invention, a toner receiving port of receiving toner discharged from the cartridge, and a toner supply container of supplying the cartridge with toner are provided to the main body side in advance, but may be mounted thereto, and in that case, such a configuration may be taken that a shutter is driven after the toner receiving port or the toner supply container is already mounted thereon.

This application claims priority from Japanese Patent Application No. 2004-329241 filed on Nov. 12, 2004, which is hereby incorporated by reference herein.

What is claimed is:

1. A cartridge detachably mounted to an image forming apparatus, comprising:

an image bearing member;

a cleaning member for removing toner on said image bearing member;

a discharge port for discharging from the cartridge the toner removed by said cleaning member;

a shutter for opening and closing said discharge port; and a lock member adapted to (i) be at a first position for preventing said shutter from being opened when the cartridge is detached from the image forming apparatus, and (ii) shift to a second position for enabling said shutter to be opened when the cartridge is mounted to the image forming apparatus, wherein said lock member shifts from the first position to the second position by contacting with a wall of the image forming apparatus.

2. The cartridge according to claim 1, wherein said lock member is contacted with said shutter to prevent movement in an opening direction of said shutter.

3. The cartridge according to claim 1, wherein said shutter is fitted to an image forming apparatus side shutter of the image forming apparatus, and said shutter is unlocked by said lock member and the image forming side shutter is moved in an integrated manner to cause said shutter to open said discharge port.

4. The cartridge according to claim 3, wherein said shutter closes said discharge port in conjunction with an opening operation of an opening/closing member that opens and closes a mounting/detaching unit for mounting and detaching the cartridge mounted in the image forming apparatus.

5. The cartridge according to claim 1, wherein when the cartridge is detached from the image forming apparatus, said shutter is locked by said lock member so as to be located at a position which allows the cartridge to fit into the image forming apparatus.

6. The cartridge according to claim 1, wherein the wall is perpendicular to an insertion direction of the cartridge.

7. A cartridge detachably mounted to an image forming apparatus, comprising:

a toner supply port through which toner is supplied from an image forming apparatus side;

a shutter for opening and closing said toner supply port; and a lock member adapted to (i) be at a first position for preventing said shutter from being opened when the cartridge is detached from the image forming apparatus, and (ii) shift to a second position for enabling said shutter to be opened when the cartridge is mounted to the image forming apparatus, wherein said lock member shifts from the first position to the second position by contacting with a wall of the image forming apparatus, and wherein said shutter is fitted to an image forming apparatus side shutter of the image forming apparatus, and said shutter is unlocked by said lock member and the image forming side shutter is moved in an integrated manner to cause said shutter to open said toner supply port.

8. The cartridge according to claim 7, wherein said lock member is contacted with said shutter to prevent movement in an opening direction of said shutter.

9. The cartridge according to claim 8, wherein said shutter closes said toner supply port in conjunction with an opening operation of an opening/closing member that opens and closes a mounting/detaching unit for mounting and detaching the cartridge mounted in the image forming apparatus.

10. The cartridge according to claim 7, wherein when the cartridge is detached from the image forming apparatus, said shutter is locked by said lock member so as to be located at a position which allows the cartridge to fit into the image forming apparatus.

11. The cartridge according to claim 7, wherein the wall is perpendicular to an insertion direction of the cartridge.

* * * * *